US007954348B2

(12) United States Patent
Forgues et al.

(10) Patent No.: US 7,954,348 B2
(45) Date of Patent: Jun. 7, 2011

(54) PEENING APPARATUS AND METHOD

(76) Inventors: Sylvain Forgues, Blainville (CA); Brigitte Labelle, Blainville (CA)

( * ) Notice: Subject to any disclaimer, the term of this patent is extended or adjusted under 35 U.S.C. 154(b) by 75 days.

(21) Appl. No.: 12/460,836

(22) Filed: Jul. 24, 2009

(65) Prior Publication Data

US 2010/0018272 A1 Jan. 28, 2010

Related U.S. Application Data

(60) Provisional application No. 61/135,993, filed on Jul. 25, 2008.

(51) Int. Cl.

| | |
|---|---|
| ***B21J 5/00*** | (2006.01) |
| ***C05B 17/00*** | (2006.01) |
| ***B21D 7/06*** | (2006.01) |

(52) U.S. Cl. ..... 72/53; 451/466

(58) Field of Classification Search ..... 72/53; 451/464, 451/465, 466, 469

See application file for complete search history.

(56) References Cited

U.S. PATENT DOCUMENTS

| | | | | |
|---|---|---|---|---|
| 3,648,498 | A * | 3/1972 | Voss et al. | 72/53 |
| 3,834,200 | A * | 9/1974 | Winter | 72/53 |
| 3,857,750 | A * | 12/1974 | Winter et al. | 428/66.7 |
| 4,481,802 | A * | 11/1984 | Harman et al. | 72/53 |
| 4,616,496 | A * | 10/1986 | Hawkins | 72/53 |
| 4,635,456 | A * | 1/1987 | Harman et al. | 72/53 |
| 4,713,952 | A * | 12/1987 | Senger et al. | 72/53 |
| 5,619,877 | A * | 4/1997 | Graf | 72/53 |

* cited by examiner

*Primary Examiner* — David B Jones

(74) *Attorney, Agent, or Firm* — Ogilvy Renault LLP

(57) ABSTRACT

A method of peening a surface which comprises the steps of providing a rotary peening tool having at least one rotating flap mounted on the drive shaft which is rotatably driven, measuring the speed of the drive shaft, and controlling the speed of the drive shaft to maintain a desired level. A peening apparatus is also disclosed.

7 Claims, 2 Drawing Sheets

PEENING APPARATUS AND METHOD

The present application claims priority based on U.S. Provisional Application Ser. No. 61/135,993 filed Jul. 25, 2008, the teachings of which are hereby incorporated by reference.

FIELD OF THE INVENTION

The present invention relates to a peening device and to a method for the operation thereof.

BACKGROUND OF THE INVENTION

As is known in the art, peening is the process of impacting a metal component with small particles generally at a right angle to the surface to be treated so as to thereby impact the surface of the metal in a direction normal thereto. The peening of the metal surface results in the material being stronger and tends to place the material in compression and relieve preexisting tensile stresses which may exist in the member. In other words, the impacting of the surface tends to place the same in compression and helps prevent fatigue, cracks and other imperfections in the surface from propagating through the surface to cause failure. The process in widely used in the aeronautical industry.

Conventional shot peening requires extensive blasting equipment and is not particularly suited to situations which require mobility of the equipment. Furthermore, in many such situations, the particles are not easily collected for recirculation. Rotary tools for shot peening are known in the art and are more adapted for applications requiring mobility. The tool will comprise a rotating shaft having drive means associated therewith and one or more flaps are attached to the shaft. Each flap has one or more hard particles or shot and the flap impacts on the work piece. Each impact produces a localized compressive stress on the surface for the reasons set forth above.

Conventional rotating peening tools are generally light weight hand tools which use a plurality of peening flaps mounted on the shaft. Each flap has one or more shot peening particles affixed to its free end and the flap is driven to impact the work surface as the flaps rotate. The art shows many different arrangements for the shot on the rotating flap.

As in any treatment, it is important to have proper control associated with the rotary peening treatment. In particular, the speed of rotation is critical in this process. At the present time, this is extremely difficult to provide since no speed controller exists.

In particular, one operator may hold the tool closer to the work piece and thus, the peening flaps strike the member to be treated at a slower pace—i.e. the rotational speed is decreased as the flap expends more energy to move past the work piece. Inversely, if the tool is held at a greater distance from the work piece whereby the outer portions of the flaps are utilized, the speed will be greater. Furthermore, the rotary peening apparatus frequently uses compressed air which often is provided through large compressors feeding several lines. When the demand on the compressor increases, the pressure in the lines might drop affecting the speed of the rotary peening apparatus.

Both the operator stability and the compressed air pressure variation, as well as several other factors, will have an impact on the speed of the rotary peening apparatus. This will have an influence on the energy transferred to the material and must therefore be kept as constant as possible to ensure a quality peening process.

SUMMARY OF THE INVENTION

It is an object of the present invention to provide a rotary peening speed control apparatus to control the rotational speed of the drive shaft and ensure proper treatment of the member being treated.

It is a further object of the present invention to provide a method for rotary peening that continuously monitors and controls the speed of rotation to ensure that the operator properly treats the member to be treated.

According to one aspect of the present invention, there is provided a method of peening a surface comprising the steps of providing a rotary peening tool having at least one rotating flap mounted on a drive shaft and having a drive means for rotatively driving the drive shaft, operating the rotary peening tool to peen the surface, measuring the speed of the drive shaft, and controlling the drive means to maintain a desired speed.

According to a further aspect of the present invention, there is provided a peening control apparatus comprising a rotary peening tool having a drive shaft and at least one rotating flap mounted thereon, drive means for driving the drive shaft, a sensor to monitor the speed of the drive shaft, a controller to receive input from the sensor, the controller being operatively connected to the drive means to increase or decrease the rotational speed to a desired value.

The apparatus of the present invention may include any suitable peening tool, many of which are commercially available. The number of flaps and/or the number of shots on each flap are irrelevant to the practice of the present invention.

The drive means may include any suitable and thus could include hydraulic, pneumatic and electric. It suffices to say that all such means are known in the art and could be practiced with the present invention.

The controller of the present invention is designed to receive a signal from the sensor measuring the speed of the shaft and to increase and/or decrease the speed in response to the measurement. Such devices are known in the art.

According to the present invention, there is provided a control device which maintains the required operating speed of the rotary peening tool.

Maintaining the speed of the shaft is extremely important, particularly in cases where the peening has been conducted on devices such as aeronautical components.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
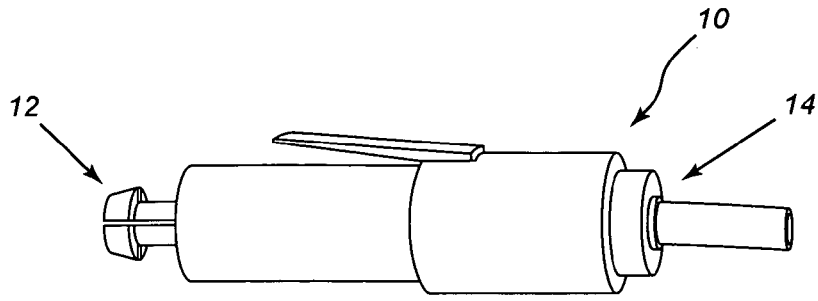
FIG. 1 is a perspective view of a rotary peening tool.
Figure 2:
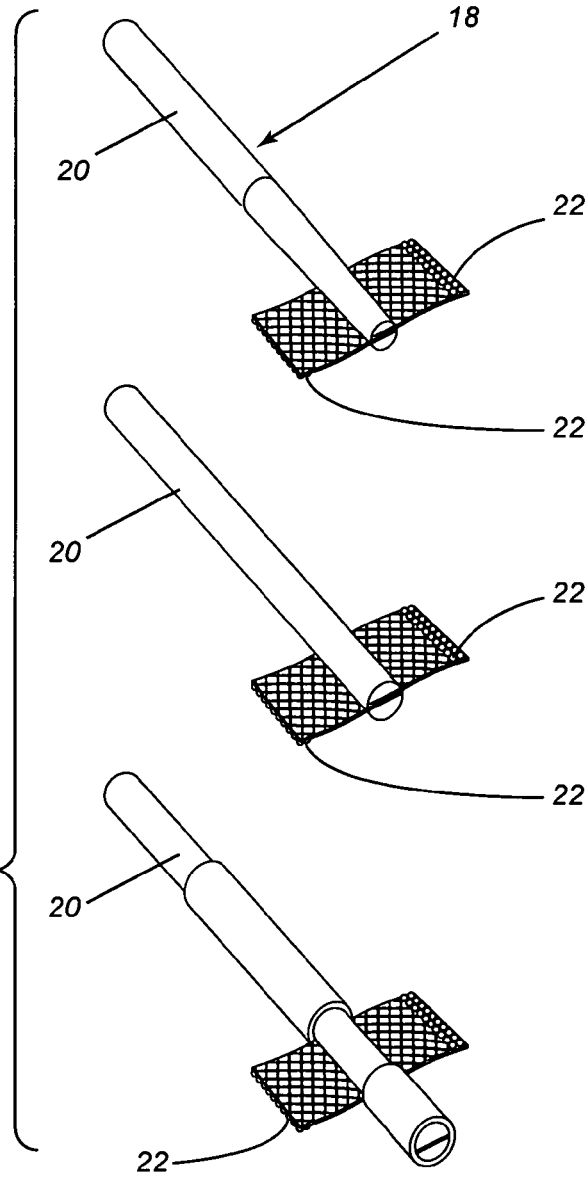
FIG. 2 is a perspective view illustrating the flaps which may be utilized with the rotary peening tool of FIG. 1.

Referring to the drawings in greater detail and by reference characters thereto, there is illustrated a typical rotary peening device generally designated by reference numeral 10. Such peening devices are well known in the art and have an arbour end 12 and an air inlet end 14. Arbour end 12 is designed to retain peening flaps 18. Each peening member 18 comprises a shaft 20 and a pair of flaps 22. Naturally, any desired number of peening flaps 18 may be provided and, as shown in FIG. 2, different arrangements may be utilized for shaft 10.

Figure 3:
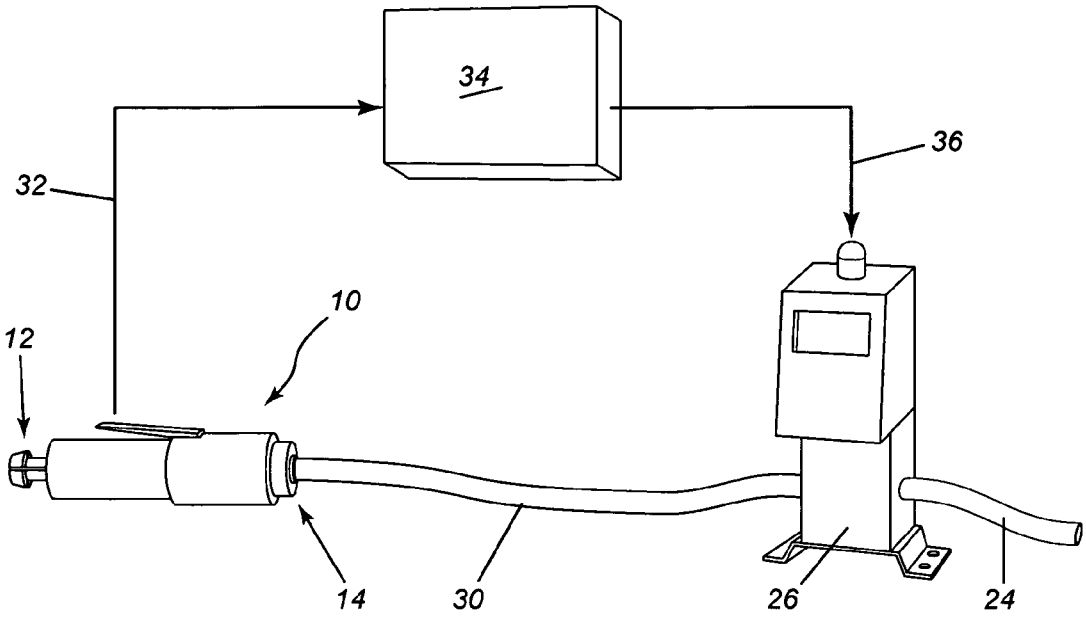
FIG. 3 is a schematic view illustrating the set up of the rotary peening control apparatus according to the present invention.

Referring to FIG. 3, an air supply line 24 feeds an adjustable valve 26. An outlet end of valve 26 has an air feed line 30 which is connected to air inlet 14 of rotary peening device 10.

The control apparatus includes a rotation speed sensor (not shown) which feeds a signal for the rotation speed sensor line 32 which is operatively connected to a microprocessor 34. Microprocessor 34 in turn sends a signal 36 to valve 26.

In operation, if the tool is being operated such that the speed of rotation is not sufficient, a signal is sent to valve 26 to increase the air pressure through air feed line 30. Inversely, if the speed of the arbour is too high, microprocessor 34 will send a signal to valve 26 to decrease the air pressure.

Naturally, other arrangements are possible. For example, if rotary peening device 10 were electrically operated, the microprocessor 34 would be similar but the corresponding electric energy adjustor would be utilized to control the speed of rotation of the arbour.

In one embodiment of the invention, the apparatus may be modified to include a software which allows the input of operator parameters. Thus, the controller would be designed to accept individual operator parameters such as speed and intensity of the peening. For example, an operator would utilize the tool on a test piece of material until a satisfactory result is achieved. The parameters for that operator could then be entered into the controller to permit operation under substantially identical conditions. A second operator may achieve results with a different speed and the tool would be operated at the desired speed.

The controller could also have means to save the process data for quality control purposes. Similarly, an alarm could be included when the conditions are not suitable.

It will be understood that the above described embodiments are for purposes of illustration only and changes and modifications may be made thereto without departing from the spirit and scope of the invention.

We claim:

1. The method of peening a surface comprising the steps of:

providing a rotary peening hand tool having at least one rotating flap mounted on a drive shaft and having a drive means for imparting a drive force for rotatively driving said drive shaft;

controlling an adjustable means connected to said drive means to adjust said drive force to maintain a substantially desired constant speed of rotation of said drive shaft;

rotating said rotary peening hand tool held in a hand of an operator person to peen said surface;

monitoring the speed of said drive shaft by a sensor as it fluctuates due to the pressure applied on said hand tool by the hand of said operator person;

feeding actual rotational speed signals of said drive shaft to a microprocessor; and controlling said adjustable means by said microprocessor to maintain said substantially desired constant speed.

2. The method of claim 1 wherein there is further provided the steps of:

storing in said microprocessor operator parameters including monitored speed and intensity of said peening hand tool used on a test piece of material by a specific operator;

entering said parameters into said microprocessor until a satisfactory peening result is achieved by said specific operator, and wherein said step of controlling said adjustable means is effected under substantially identical conditions by said microprocessor to achieve said satisfactory peening result when said peening tool is operated again by said specific operator.

3. The method of claim 2 wherein said drive means is a pneumatic drive, said adjustable means being an adjustable valve connected to a pneumatic drive force of said pneumatic drive.

4. A rotary peening control apparatus for controlling the speed of a rotary peening hand tool when held in a hand of an operator person effecting a peening operation, comprising:

said rotary peening hand tool having a drive shaft and at least one rotating flap mounted thereon, drive means for imparting a drive force for driving said drive shaft;

an adjustable means connected to said drive means for adjusting said drive force to maintain a substantially desired speed of rotation of said drive shaft;

a sensor to monitor the speed of said drive shaft, said sensor feeding actual rotational speed signals of said drive shaft to a microprocessor as the speed of said drive shaft fluctuates depending on pressure applied on said hand tool by the hand of an operator person;

said microprocessor operatively connected to said adjustable means to increase or decrease the rotational speed to maintain said substantially desired constant speed.

5. The apparatus of claim 4 wherein said drive means comprise pneumatic drive means, said adjustable means being an adjustable valve.

6. The apparatus of claim 5 wherein said rotary peening tool has a plurality of rotating flaps mounted on said drive shaft.

7. The apparatus of claim 4 wherein said microprocessor includes means for storing operator parameters;

said operator parameters including monitored speed and intensity of said peening hand tool used on a test piece material by a specific operator and entered into said microprocessor of said control apparatus to achieve a satisfactory peening result, said controller permitting operation of said peening hand tool by said specific operator under substantially identical conditions with said microprocessor controlling said adjustable means.

* * * * *